US008215796B2

(12) United States Patent
Luo et al.

(10) Patent No.: US 8,215,796 B2
(45) Date of Patent: Jul. 10, 2012

(54) LIGHTING DEVICE

(75) Inventors: Ting Luo, Shenzhen (CN); Xian-Wei Ma, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 435 days.

(21) Appl. No.: 12/565,764

(22) Filed: Sep. 24, 2009

(65) Prior Publication Data

US 2011/0038164 A1 Feb. 17, 2011

(30) Foreign Application Priority Data

Aug. 14, 2009 (CN) ..... 2009 1 0305625

(51) Int. Cl.
*F21V 21/00* (2006.01)
*F21S 4/00* (2006.01)

(52) U.S. Cl. ..... 362/249.12; 362/362; 362/249.01; 362/249.02; 362/249.05; 362/249.11; 315/320

(58) Field of Classification Search ..... 362/362, 362/249.12, 249.01–249.11; 315/320
See application file for complete search history.

(56) References Cited

U.S. PATENT DOCUMENTS

| | | | | |
|---|---|---|---|---|
| 7,942,540 | B2 * | 5/2011 | Harbers et al. | 362/84 |
| 2010/0127637 | A1 * | 5/2010 | Alexander et al. | 315/294 |
| 2011/0063849 | A1 * | 3/2011 | Alexander et al. | 362/294 |

* cited by examiner

*Primary Examiner* — Diane Lee
*Assistant Examiner* — Jessica M Apenteng
(74) *Attorney, Agent, or Firm* — Altis Law Group, Inc.

(57) ABSTRACT

A lighting device comprising: a shell; a first circuit; a light source set in the shell; an axis mounted in the shell; and an effective amount of conducting liquid. A rotation device and a switch device are rotatably connected to the shell via the axis. The switch device comprises a first storing cavity and a second storing cavity, which is configured for accommodating the conducting liquid. The first storing cavity communicates with the second storing cavity. A plurality of pairs of third grooves is formed in the first storing cavity. Each of which is set a pair of positive/negative terminals. Each of the pairs of positive/negative terminals is electronically connected to light source and the first circuit. A slide bar is formed on the rotation device, and is configured for pushing the conducting liquid inside of the first storing cavity.

11 Claims, 6 Drawing Sheets

LIGHTING DEVICE

BACKGROUND

1. Technical Field

The present disclosure relates to a lighting device.

2. Description of Related Art

Generally, a plurality of luminophors of a lighting device are still exposed to the outside when the luminophors are in a turned off state. As a result, the luminophors may be easily destroyed.

Therefore, what is needed is a lighting device which can hide the luminophors, when the luminophors are in a turned off state.

DETAILED DESCRIPTION

Figure 1:
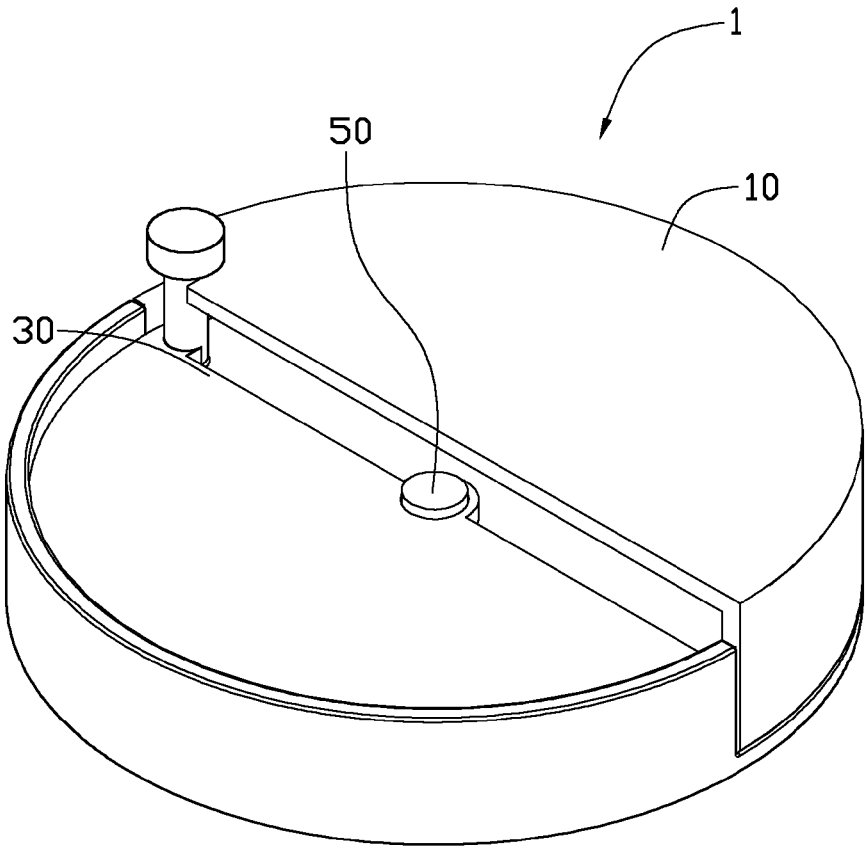
FIG. 1 is an isometric view of a lighting device in a closed state in accordance with an exemplary embodiment.
Figure 2:
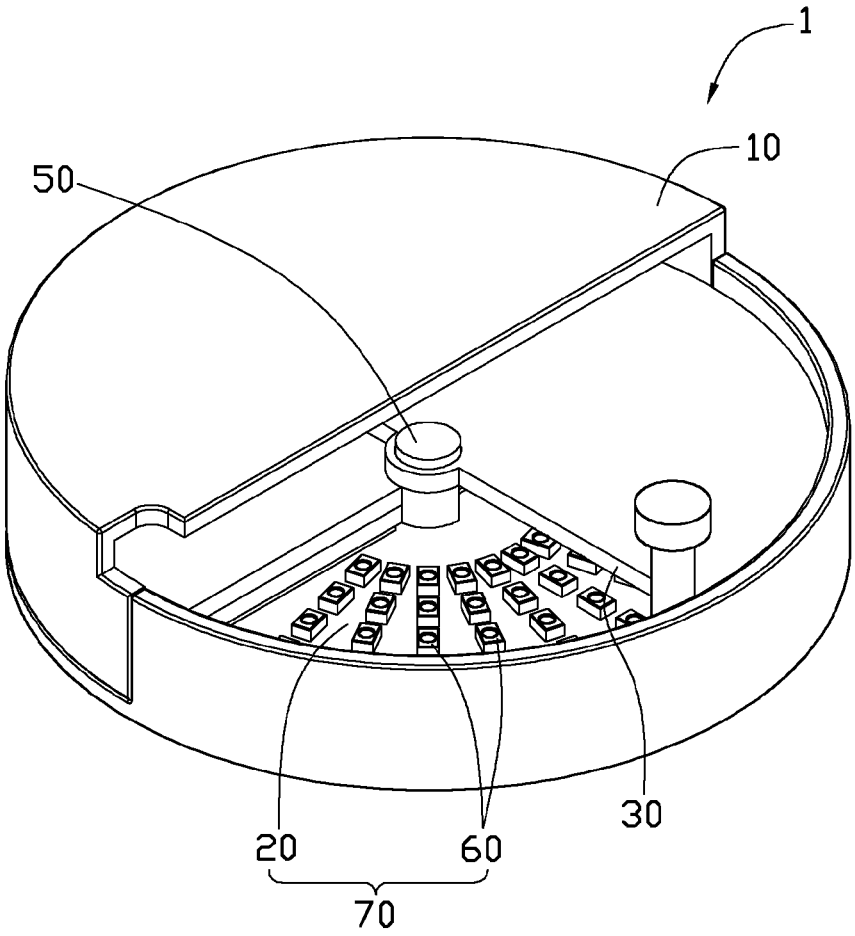
FIG. 2 is an isometric view of a lighting device of FIG. 1 in a half open state in accordance with an exemplary embodiment.

Referring to FIGS. 1-2, a lighting device 1 is disclosed. The lighting device 1 includes a shell 10, a rotation device 30, an axis 50, and a light source 70. The rotation device 30 is rotatably connected to the shell 10 via the axis 50. In the exemplary embodiment, the shell 10 is a hollow cylinder.

Figure 3:
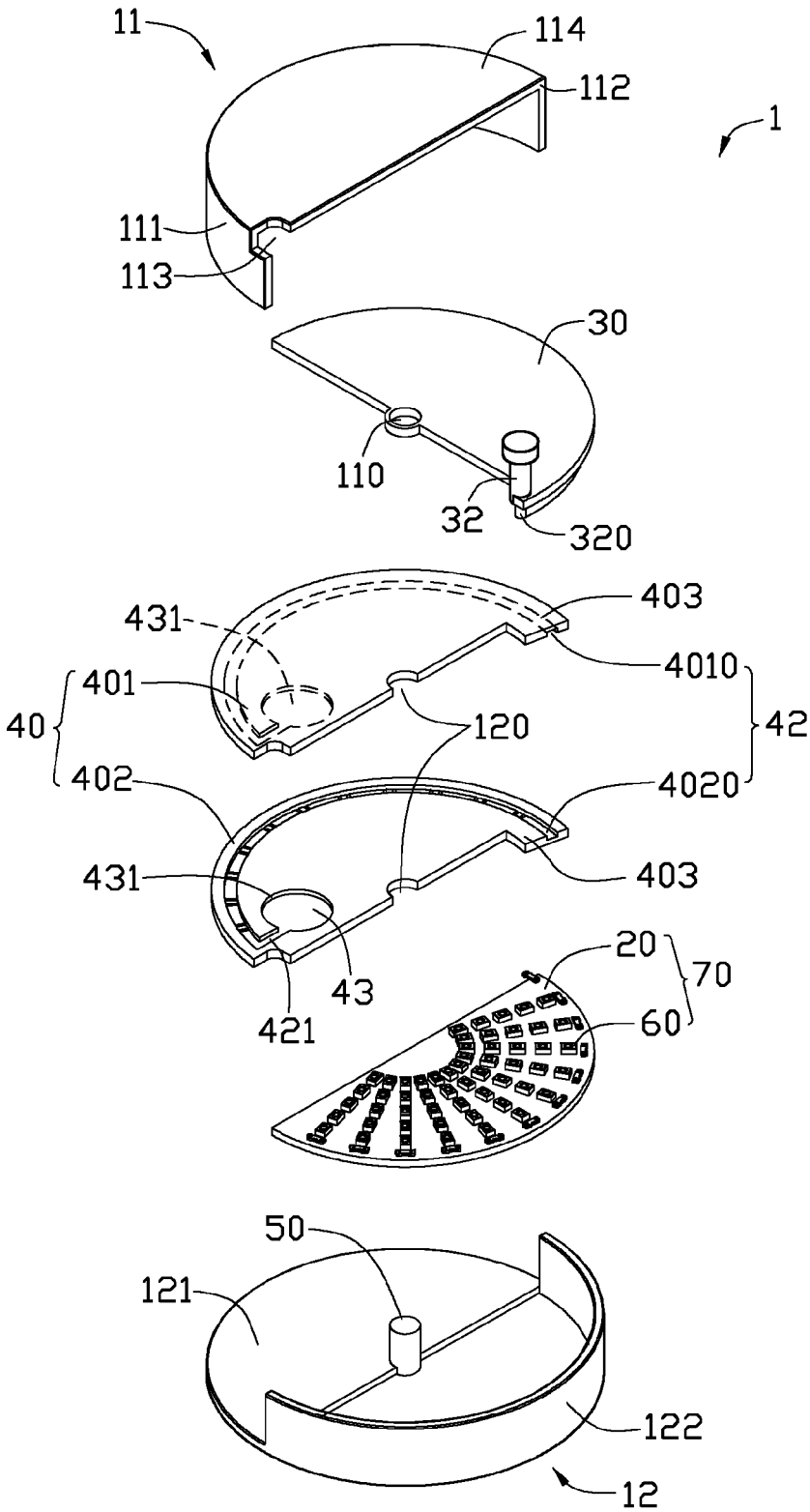
FIG. 3 is an exploded view of the lighting device of FIG. 1.

Referring to FIG. 3, the shell 10 includes an upper shell 11 and a lower shell 12. The upper shell 11 includes a semicircle top plate 114, a first sidewall 111, and an edge 112. The first sidewall 111 is vertically extended from a curved edge of the top plate 114. The edge 112 is formed at an intersection between the top plate 114 and the first sidewall 111. A cutout 113 is formed at one end of the edge 112.

The lower shell 12 includes a circular bottom plate 121 and a second sidewall 122. The second sidewall 122 is vertically extended from a part of the circumference of the bottom plate 121. In the exemplary embodiment, the height of the bottom plate 121 where the second sidewall 122 extends from is less than that of the remaining portion of the bottom plate 121, substantially by an amount of the height of the light source 70 with luminophors 60 installed thereon. The second sidewall 122 cooperates with the first sidewall 111 to form a cylindraceous sidewall. The height of the first sidewall 111 is higher than that of the second sidewall 122. The axis 50 is vertically fixed in the center of the inner surface of the bottom plate 121.

The light source 70 includes a main body 20 and one or more luminophors 60. The luminophors 60 are set in the surface of the main body 20. In the exemplary embodiment, the main body 20 is a semicircle sheet, and is placed on the portion of the lower shell 12 where it is partially encircled by the second sidewall 122.

The light device 1 further includes a switch device 40 placed on the inner surface of the lower shell 12. The switch device 40 is semicircle shaped, and is rotatably connected to the shell 10 via the axis 50. A second cutout 120 is formed in the center of a straight edge of the switch device 40. An extension portion 403 is extended from a curved edge of the switch device 40. The switch device 40 further includes an upper portion 401 and a lower portion 402 which are semicircle shaped.

A first groove 4010 is formed along a curved edge of the upper portion 401. A second groove 4020 is formed along a curved edge of the lower portion 402, corresponding the first groove 4010. In the exemplary embodiment, the first groove 4010 has a same structure as that of the second groove 4020, and cooperates with the second groove 4020 to form a first storing cavity 42. A fourth groove 431 is formed in the upper portion 401 and the lower portion 402 respectively. The fourth groove 431 of the upper portion 401 cooperates with the fourth groove 431 of the lower portion 402 to form a second storing cavity 43. The volume of the second storing cavity 43 is larger than that of the first storing cavity 42. The first storing cavity 42 communicates with the second storing cavity 43, and is configured for accommodating conducting liquid.

Figure 5:
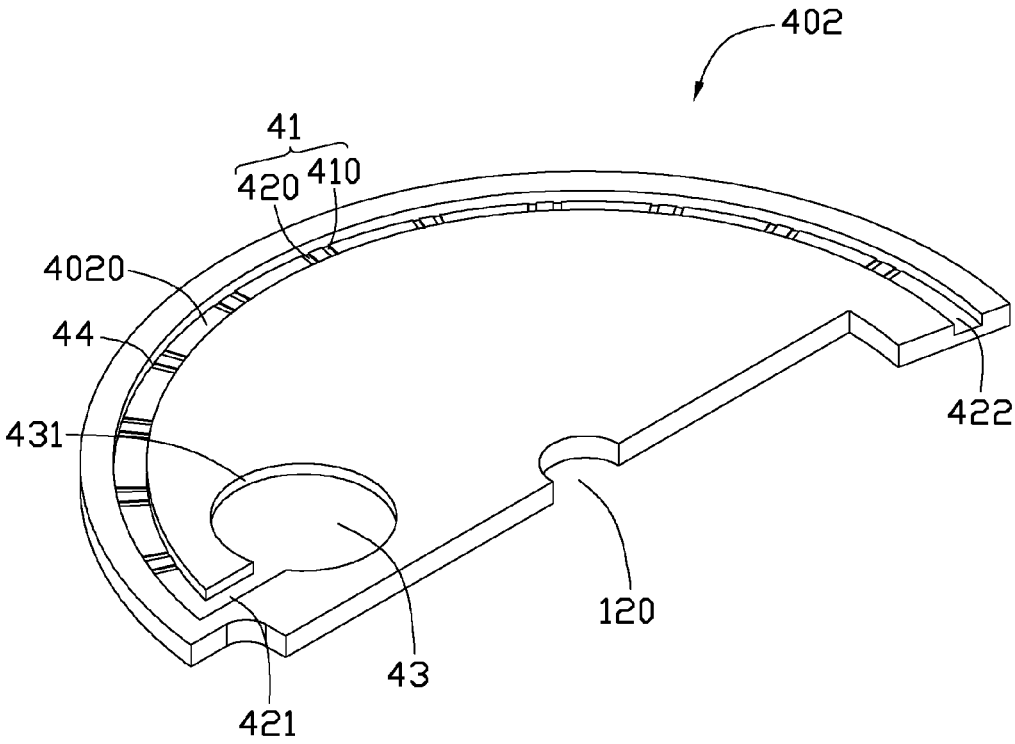
FIG. 5 is an enlarged view of a rotation device of the lighting device of FIG. 1.

Referring to FIG. 5, a plurality of pairs of third grooves 44 are formed in the second groove 4020, across the second groove 4020 transversely. Each of the pairs of the third grooves 44 is set with a pair of positive/negative terminals 410, 420, which forms a switch 41. Each of the switches 41 is electronically connected to one or more luminophors 60, and is configured for turning on/off the luminophors 60.

Figure 4:
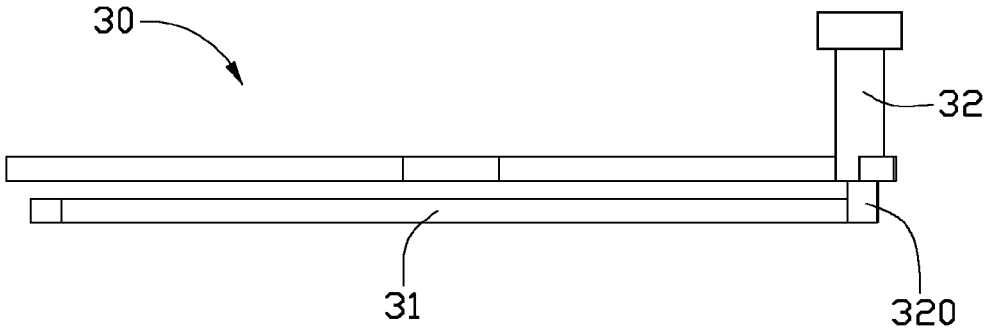
FIG. 4 is an enlarged view of a lower portion of a switch device of the lighting device of FIG. 1.

Referring to FIG. 4, the rotation device 30 is semicircle shaped, and is positioned between the top plate 114 and the main body 20. The rotation device 30 includes a holder 32, a cantilever 320, and a slide bar 31. A first through hole 110 is formed on a center of a straight edge of the rotation device 30, and corresponds to the second cutout 120. The holder 32 is protruded from one end of a curved edge of the rotation device 30. The cantilever 320 is formed in a bottom of the holder 32 of the rotation device 30. The slide bar 31 is semicircle bar, and is formed on the bottom surface of the rotation device 30. One end of the slide bar 31 is fixed in the cantilever 320. The height of an interspace between the bottom surface of the rotation device 30 and the slide bar 31 is equal to the thickness of the upper portion 401 of the switch device 40 minus the depth of the first groove 4010, so that, the slide bar 31 can be received into the first storing cavity 42, and slides along the first storing cavity 42. In the exemplary embodiment, after being received in the first storing cavity 42, the outer surface of the slide bar 31 totally blocks the first storing cavity 42 cross-sectionally, thereby, the conducting liquid is pushed from the first storing cavity 42 to the second storing cavity 43 by sliding of the slide bar 31.

When assembling the lighting device 1, first, the conducting liquid is poured into the first storing cavity 42, the free end of the slide bar 31 is inserted into the first storing cavity 42 from one end with the extension portion 403, and pushes the holder 32 to rotate, thereby, the slide bar 31 is received into the first storing cavity 42. The first through hole 110 is aligned to the second cutout 120. Thus, the main body 20 is put in the portion of the lower shell 12 where it is encircled by the second sidewall 122, and the switch device 40 is put in the portion of the bottom plate 121 where it is not encircled by the second sidewall 122. Due to the height of the portion of the bottom plate 121 where it is not encircled by the second sidewall 122 is larger than the thickness of the main body 20, substantially by an amount of the height of the light source 70 with luminophors 60 installed thereon, so that, the extension portion 403 of the switch device 40 can be covered with the main body 20, and the slide bar 31 will not collide with the luminophors 60 of the main body 20 when sliding along the first storing cavity 42.

When the holder 31 is driven to position on the cutout 113 of the upper shell 11, the conducting liquid flows from the second storing cavity 43 to the first storing cavity 42 and the one or more luminophors are covered by the rotation device 30. Thus, the positive/negative terminals 410, 420 is connected by the conducting liquid, thereby, the switch 41 is connected. Due to the free end 320 of the slide bar 31 is still received in the first storing cavity 42, so that, the conducting liquid cannot flow out from the first storing cavity 42.

Figure 6:
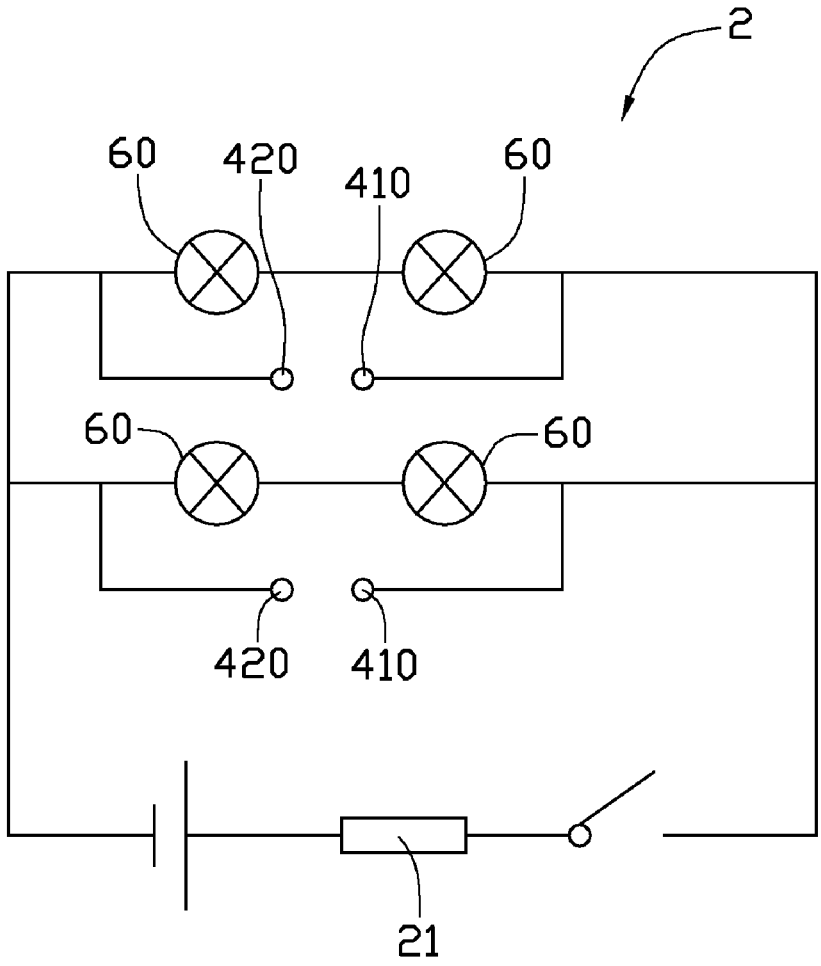
FIG. 6 is a circuit diagram of the lighting device of FIG. 1.

Referring to FIG. 6, when the positive/negative terminals 410, 420 is connected by the conducting liquid, and thus, the switch 41 is connected, thereby, the first circuit 2 is connected, and one or more luminophors 60 connected to the first circuit 2 are turned off.

When the holder 32 is driven to drive the slide bar 31 to slide along the first storing cavity 42, the luminophors 60 of the main body 20 are gradually exposed to the user, and the conducting liquid is gradually pushed from the first storing cavity 42 to the second storing cavity 43. Thus, the switches 41 are gradually disconnected, so that, the luminophors 60 connected to the switch 41 are gradually turned on. When the slide bar 31 is arrived at one end 421 of the first storing cavity 42, the rotation device 30 is completely opened, and the conducting liquid of the first storing cavity 42 is wholly pushed to the second storing cavity 43, thus, the all luminophors 60 are exposed to the user, and are turned on.

In the exemplary embodiment, the first circuit 2 further includes at least one safeguard-resistor 21. When the all switches 41 are connected by the conducting liquid, the all luminophors 60 connected to the first circuit 2 are turned off and the safeguard-resistor 21 is configured for protecting the power supply, which supply power for the lighting device 1.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A lighting device comprising:

a shell;

a first circuit;

a light source set in the shell;

an axis mounted in the shell;

an effective amount of conducting liquid;

a rotation device and a switch device rotatably connected to the shell via the axis, the switch device comprising a first storing cavity and a second storing cavity configured for accommodating the conducting liquid, wherein, the first storing cavity communicates with the second storing cavity;

a plurality of pairs of first grooves formed in the first storing cavity, each of which set a pair of positive/negative terminals, and each of the pairs of positive/negative terminals are electronically connected to light source and the first circuit, and can be connected by the conducting liquid flowing over thereof; and a slide bar formed on the rotation device, and configured for pushing the conducting liquid inside of the first storing cavity;

wherein, when the conducting liquid of the first storing cavity is pushed to the second storing cavity by the slide bar, every pair of the positive/negative terminals is disconnected in turn, and the first circuit in relation to the connected terminals is connected, and the light source is in turn exposed, and turned on;

when the rotation device is gradually driven to exit the first storing cavity, thereby, the slide bar is exited from the first storing cavity, the conducting liquid of the second storing cavity flows into the first storing cavity, and every pair of the positive/negative terminals is connected in turn, thereby, the light source is hid and turned off.

2. The lighting device as described in claim 1, wherein the light source comprises a main body, and one or more luminophors set in the surface of the main body, every pair of the positive/negative terminals is configured for turning on/off the one or more luminophors.

3. The lighting device as described in claim 2, wherein the shell comprises an upper shell and a lower shell, the upper shell comprises a top plate, a first sidewall vertically extended from a curved edge of the top plate, and an edge formed at an intersection between the top plate and the first sidewall, a cutout is formed in one end of the edge;

a holder is protruded from one end of a curved edge of the rotation device;

when the holder is droved to position on the cutout of the upper shell, the conducting liquid flows from the second storing cavity to the first storing cavity and the one or more luminophors are hid.

4. The lighting device as described in claim 3, wherein a cantilever is formed in a bottom of the holder of the rotation device; the slide bar is formed, corresponding to the shape of the first storing cavity, in the bottom surface of the rotation device, and one end of the slide bar is fixed to the cantilever.

5. The lighting device as described in claim 3, wherein when the slide bar is received into the first storing cavity, the outer surface of the slide bar totally blocks the first storing cavity cross-sectionally.

6. The lighting device as described in claim 5, wherein the height of an interspace between the bottom surface of the rotation device and the slide bar is equal to a thickness of the upper portion of the switch device minus the depth of the second groove.

7. The lighting device as described in claim 3, wherein the lower shell comprises a bottom plate and a second sidewall vertically extended from a part of the circumference of the bottom plate;

the height of the bottom plate where the second sidewall extends from is less than that of the remaining portion of the bottom plate, substantially by an amount of the height of the light source with luminophors installed thereon.

8. The lighting device as described in claim 7, wherein the height of the first sidewall is higher than that of the second sidewall.

9. The lighting device as described in claim 7, wherein the axis is vertically fixed in the center of the inner surface of the bottom plate.

10. The lighting device as described in claim 1, wherein the switch device comprises an upper portion and a lower portion, a second groove is formed along a curved edge of the upper portion, and a third groove is formed along a curved edge of the lower portion, the second groove cooperates with the third groove to form the first storing cavity;

a fourth groove is formed in the upper portion and the lower portion respectively, the fourth groove of the upper portion cooperates with the fourth groove of the lower portion to form a second storing cavity.

11. The lighting device as described in claim 10, wherein the volume of the second storing cavity is greater than that of the first storing cavity.

* * * * *